United States Patent [19]

Schulz et al.

[11] 4,020,004

[45] Apr. 26, 1977

[54] CONVERSION OF RADIOACTIVE FERROCYANIDE COMPOUNDS TO IMMOBILE GLASSES

[75] Inventors: Wallace W. Schulz; A. Louise Dressen, both of Richland, Wash.

[73] Assignee: The United States of America as represented by the United States Energy Research and Development Administration, Washington, D.C.

[22] Filed: Nov. 21, 1975

[21] Appl. No.: 634,224

[52] U.S. Cl. ..... 252/301.1 W; 106/52; 106/54

[51] Int. Cl.[2] ..... G21F 9/34

[58] Field of Search ..... 252/301.1 W; 106/52, 106/54

[56] References Cited

UNITED STATES PATENTS 2,769,780 11/1956 Clifford et al. ..... 252/301.1 W

OTHER PUBLICATIONS

Thiele, D. "Use of Extrusions. . .Products", Ber. Kernforschungsanlage Juelich 1973, as abstracted in Chem. Abstracts, vol. 80, No. 14852b.

Kupfer, M. J. et al., "Endothermic Process", 1973, as abstracted in Chem. Abstracts, vol. 80, No. 124325f.

Amphlett, C. B. Treatment and Disposal of Radioactive Wastes, Pergammon Press New York, 1961, pp. 93–102.

*Primary Examiner*—Benjamin R. Padgett
*Assistant Examiner*—Deborah L. Kyle
*Attorney, Agent, or Firm*—Dean E. Carlson; Richard E. Constant; Robert M. Poteat

[57] ABSTRACT

Complex radioactive ferrocyanide compounds result from the scavenging of cesium from waste products produced in the chemical reprocessing of nuclear fuel. These ferrocyanides, in accordance with this process, are converted to an immobile glass, resistant to leaching by water, by fusion together with sodium carbonate and a mixture of (a) basalt and boron trioxide ($B_2O_3$) or (b) silica ($SiO_2$) and lime (CaO).

7 Claims, No Drawings

CONVERSION OF RADIOACTIVE FERROCYANIDE COMPOUNDS TO IMMOBILE GLASSES

CONTRACTUAL ORIGIN OF THE INVENTION

This invention described herein was made in the course of, or under, a contract with the United States Atomic Energy Commission (now the United States Energy Research and Development Administration). The present invention relates generally to nuclear waste disposal processes and more particularly to a method of immobilizing radioactive ferrocyanides in virtually insoluble glass products.

BACKGROUND OF THE INVENTION

One of the important fission products present in waste solutions resulting from the chemical reprocessing of nuclear fuels is cesium-137. Minor amounts of the Cs-134 isotope are also present in these solutions. The cesium-137 is highly radioactive and, as part of the waste management program, it is desirable to separate it from other, non-radioactive or less radioactive, constituents. One method that has been employed is precipitation from alkaline solutions by the addition of a soluble nickel, zinc, cupric, cobaltous, cadmium, uranyl, or manganous salt, and potassium ferrocyanide. This gives a complex ferrocyanide precipitate containing cesium, which may be represented by the general formula $^{134\text{-}137}Cs_aM_b.\ [Fe(Cn)_6]_c\ .\ h_2O$, where M represents Ni, Zn, Cu, Fe, Co, Cd, $UO_2$ or Mn; *a*, *b*, and *c* are integers; and *x* is zero or a small number. A particularly important precipitate of this class is cesium nickel ferrocyanide, which is stored in large quantities in underground tanks at the Hanford Works located near Richland, Washington, USA, See U.S. Pat. No. 2,769,780, granted Nov. 6, 1956, to W. E. Clifford and R. E. Burns, and U. S. Atomic Energy Commission Reports TID-7515 (p. 290) and HW-70874.

By various methods, it is possible to recover the cesium from this precipitate. However, the supply of cesium-137 available far exceeds the present demand for industrial uses. The precipitate is slightly soluble and, because of its finely divided, and high surface area character, might present some hazard if it should escape. It is therefore desirable to be able to convert the ferrocyanide to an immobile, less soluble product. The ferrocyanide precipitation process is also in use at other locations in various countries. Many locations lack the favorable geological and climatic conditions of Hanford for the storage of radioactive wastes and for those sites the conversion to a less mobile, less soluble product is still more desirable.

Prior publications have shown the use of basalt to form glasses with nuclear wastes in which fission products, including cesium-137, are immobilized. See "The Endothermic Process - Application to Immobilization of Hanford In-Tank Solidified Waste," by Michael J. Kupfer and Wallace W. Schulz, U.S. Atomic Energy Commission Report ARH-2800.

Incorporation of radioactive wastes in soda-lime glass prepared from sand, lime, and sodium carbonate is also known.

However, no previous work of which we are aware solves the problem of the immobilization of the complex cesium ferrocyanides and it is the object of our invention to provide a process for incorporating those compounds in a dense, insoluble glass.

SUMMARY OF THE INVENTION

A radioactive ferrocyanide of the formula $^{134\text{-}137}Cs_aM_b[Fe(Cn)_6]_c\ .\ xH_2O$, where M represents Ni, Zn, Cu, Fe, Co, Cd, $UO_2$ and Mn; *a*, *b*, and *c* are integers numbers and *x* is zero or a small number, is converted to a dense immobile glass of low leachability by melting it with sodium carbonate ($Na_2CO_3$) and a mixture of (a) basalt and boron trioxide ($B_2O_3$or (b) silica ($SiO_2$and lime (CaO).

DETAILED DESCRIPTION

The process involves the use of finely ground constituents. They are mixed together in the dry state, melted, and allowed to solidify. The melting may be carried out in the canister or other receptacle in which the product will be stored, ot it can be carried out in a separate melter and the molten product poured into the storage canister.

The following examples illustrate specific embodiments of the process.

EXAMPLE I

In carrying out the "basalt" process, the basalt is finely ground and mixed with the complex ferrocyanide, sodium carbonate, and boron trioxide. The latter two constituents lower the melting point of the mixture and, in addition, the boron has been found to lessen the volatilization of the cesium. However, too much boron has been found to increase the leachability of the glass. The $B_2O_3$ may constitute from 5 to 15 percent by weight of the charge. The $Na_2CO_3$ may range from 15 to 25 percent by weight.

While the sodium carbonate and boron trioxide lower the melting point of the basalt to about 1000° C, it is desirable, in order to secure good incorporation of the cesium and other elements to heat the mixture to about 1200° C.

The molten glass can be poured into stainless steel canisters and allowed to harden. The canisters can then be stored with adequate circulation of air or water provided to remove the heat generated. See for example U.S. Atomic Energy Report ARH-2888 Rev. July 1974, "Retrievable Surface Storage Facility Alternative Concepts - Engineering Study."

While the stored precipitate may be more complex, it is reasonably represented by the compound $Cs_2Ni[Fe(CN)_6]$. For purposes of this experiment that compound was prepared by the addition of appropriate amounts of $K_4Fe(CN)_6$ and $Ni(NO_3)_2$ reagents to a non-radioactive 0.01 M $CsNO_3$ solution which was 5.5M in $NaNO_3$ and had a pH of 10. The resulting precipitate was washed with water and dried overnight at 100° C.

Basalt having the composition by weight 52% $SiO_2$, 14% FeO, 13% $Al_2O_3$, 8% CaO, 4% MgO, 3% $Na_2O$, 2.5% $TiO_2$ and 1.5% $K_2O$ and melting at about 1200° C was crushed and screened. The portion finer than 30 mesh (595 microns) was used. The crushed basalt was mixed with $B_2O_3$, $Na_2CO_3$ and $Cs_2Ni\ [Fe(CN)_6]$ to form 100 gram charges. Each charge contained, by weight, 10% $B_2O_3$ and 20% $Na_2CO_3$. The proportions of the other constituents are shown in Table I.

TABLE I

| Charge Composition $Cs_2Ni[Fe(CN)_6]$ | Wt.% Basalt | Percent Cesium Volatilized | Product Density g/cm³ | Product Appearance | Product Leach Rate in Water g/cm² - day |
|---|---|---|---|---|---|
| 10 | 60 | 0.20 | 2.67 | Glass | $8.62 \times 10^{-6}$ |
| 20 | 50 | 0.20 | 2.69 | Glass | $1.86 \times 10^{-5}$ |
| 30 | 40 | 0.23 | 2.84 | Glass | $3.71 \times 10^{-5}$ |

The charges were placed in a graphite-clay crucible which in turn was placed in a furnace maintained at 1200° C and heated for an hour. An inverted quartz funnel covered the crucible and was connected by a condenser and traps to a vacuum pump. Any cesium volatilized was condensed and its weight determined.

The glass product was crushed and screened. The 14 to 20 mesh (U.S. Standard Sieve Series) fraction was taken for leach tests.

Leach tests were performed with 15 to 25 grams of the dried 14 to 20 mesh material which, for calculation of surface area, was assumed to consist of 0.11 cm diameter spheres. (The value 0.11 cm is the average of the width of the openings, 0.14 and 0.084 cm, respectively, of 14 and 20 mesh screens). Total surface area of the weighed leach samples was estimated from the weight and surface area of a counted number of the (assumed) 0.11 cm. diameter pieces.

The test material was supported on stainless steel screen and airlift circulators were used to circulate 200 ml of distilled and deionized water over the sample pieces. Test samples were leached initially for 24 hours at 25° C and then, after changing of the leach liquor, for 96 hours more at 25° C. Cesium was determined by atomic absorption methods.

The leach rate was determined by the formula:

$$\text{Leach rate (g/cm}^2\text{ day) based on Cs} = \frac{\text{g of Cs leached}}{\text{(g of Cs/g of sample) (sample area, cm}^2\text{) (time, days).}}$$

Results are tabulated in Table I.

The final product in all cases was a dense, emerald green colored glass very resistant to leaching by water. We and many other investigators have noted that leach rates of radioactive glass generally decrease by one or two orders of magnitude as leaching continues. Hence, leach rates listed in Table I may be taken as maximum values. The volume of glass obtained with a charge containing 20% by weight $Cs_2Ni[Fe(Cn)_6]$ is about 1.3 times the volume of dry $Cs_2Ni\ [Fe(CN)_6]$ but only about half that of the wet precipitate.

The small amounts of cesium volatilized (see Table I) can be recovered by washing the equipment with water and reprecipitating the complex ferrocyanide, which may be recycled to the process.

While the metal indicated by "M" in the general formula is nickel in the above example, the ferrocyanides in which the metal is zinc, copper, iron, cobalt, cadmiun or manganese, or in which the radical $UO_2^{++}$ is substituted, can be used instead.

As is shown by Table I, the leachability of the product increases with increasing proportions of the ferrocyanide in the mixture. For this reason, and also to obtain a good quality glass, the upper limit of the ferrocyanide in the mixture is set at 30%. There is no lower operative limit. The lower the proportion of ferrocyanide, the greater the bulk for a given cesium content, however, and the desirable lower limit is about 10 percent. The preferred proportions by weight are about 20% ferrocyanide, 10% $B_2O_3$, 20% $Na_2CO_3$, 50% basalt.

EXAMPLE II

In the "soda-lime" process fine sand or crushed quartz, calcium oxide and sodium carbonate are employed.

The following ranges or proportions of charge constituents can be employed in percent by weight:

| | |
|---|---|
| Ferrocyanide precipitate | 10–30 |
| $SiO_2$ | 40–60 |
| $Na_2CO_3$ | 15–25 |
| CaO | 5–10 |

A preferred charge composition, in percent by weight is:

| | |
|---|---|
| $Cs_2Ni[Fe(CN)_6]$ | 20 |
| $SiO_2$ | 50 |
| $Na_2CO_3$ | 21 |
| CaO | 9 |

The manner of preparing and handling the soda-lime glass is the same as for the basalt glass, except that slightly higher temperatures (1250° C to 1350° C) are employed.

While we have described specific embodiments of our invention, it is obvious that various changes can be made. For example, while we have shown batch melting, continuous melting techniques such as are used in the glass industry can also be used.

We therefore wish our invention to be limited solely by the scope of the appended claims.

We claim as our invention:

1. A method of converting solid radioactive ferrocyanide precipitates of the general formula $^{134\text{-}137}Cs_aM_b[FE(CN)_6]_c \cdot xH_2O$, where M represents Ni, Cu, Fe, Co, Cd, Mn or $UO_2$; *a*, *b*, and *c* are integers; and *x* is zero or a small number, to an insoluble silicate glass comprising the step of heating and melting said radioactive ferrocyanide in a charge consisting essentially of from 10 to 30 percent of said ferrocyanide and from 15 to 25 percent sodium carbonate and a mixture selected from the group consisting of (a) from 40 to 60 percent basalt and from 5 to 15 percent boron trioxide and (b) from 40 to 60 percent silica and from 5 to 10 percent calcium oxide.

2. The method of claim 1 wherein M represents nickel.

3. A method as defined in claim 1 wherein said charge is in the dry state prior to said heating and consists essentially of 10 to 30 percent said ferrocyanide, 5 to 15 percent $B_2O_3$, 40 to 60 percent basalt, and 15 to 25 percent $Na_2CO_3$, and said heating is to a temperature of about 1200° C.

4. A method as defined in claim 3 wherein said charge consists essentially of 10 percent $B_2O_3$, 20 percent $Na_2CO_3$, 10 to 30 percent said ferrocyanide, balance basalt.

5. A method as defined in claim 4 wherein said basalt has substantially the following composition by weight 52% $SiO_2$, 14% FeO, 13% $Al_2O_3$, 8% CaO, 4% MgO, 3% [NaO] $Na_2O$, 2.5% $TiO_2$ and 1.5% $K_2O$.

6. A method as defined in claim 1 wherein said charge is in the dry state prior to said heating and consists essentially of 10 to 30 percent said ferrocyanide, 40 to 60 percent $SiO_2$, 15 to 25 percent $Na_2CO_3$, and 5 to 15 percent CaO, and said heating is to a temperature in the range of from about 1250° C. to about 1350° C.

7. A method as defined in claim 6 wherein said charge consists essentially of 20% said ferrocyanide, 50 percent $SiO_2$, 21 percent $Na_2CO_3$ and 9 percent CaO.

* * * * *